US011739590B2

(12) United States Patent
Schwandt et al.

(10) Patent No.: US 11,739,590 B2
(45) Date of Patent: Aug. 29, 2023

(54) RAILS FOR A COVERING FOR AN ARCHITECTURAL OPENING

(71) Applicant: Hunter Douglas Inc., Pearl River, NY (US)

(72) Inventors: Mark A. Schwandt, Thornton, CO (US); Martin A. Stebenne, Westminster, CO (US)

(73) Assignee: Hunter Douglas Inc., Pearl River, NY (US)

( * ) Notice: Subject to any disclaimer, the term of this patent is extended or adjusted under 35 U.S.C. 154(b) by 392 days.

(21) Appl. No.: 16/886,083

(22) Filed: May 28, 2020

(65) Prior Publication Data

US 2020/0291719 A1 Sep. 17, 2020

Related U.S. Application Data

(63) Continuation of application No. 15/045,319, filed on Feb. 17, 2016, now Pat. No. 10,697,233.

(51) Int. Cl.

| | |
|---|---|
| ***E06B 9/266*** | (2006.01) |
| ***E06B 9/262*** | (2006.01) |
| ***E06B 9/323*** | (2006.01) |

(52) U.S. Cl.

CPC ..... *E06B 9/266* (2013.01); *E06B 9/262* (2013.01); *E06B 9/323* (2013.01); *E06B 2009/2627* (2013.01)

(58) Field of Classification Search

CPC ..... E06B 9/266; E06B 9/323; E06B 9/262; E06B 2009/2627; E06B 2009/2625; E06B 2009/2441; E06B 2009/588; E06B 9/17076

USPC ..... 49/478.1

See application file for complete search history.

(56) References Cited

U.S. PATENT DOCUMENTS

| | | | | |
|---|---|---|---|---|
| 1,835,775 | A | 12/1931 | Hay | |
| 1,908,839 | A | 5/1933 | Greig | |
| 1,918,924 | A | 7/1933 | O'Heir | |
| 2,517,966 | A | 8/1950 | Boye | |
| 2,639,461 | A | 5/1953 | Fry | |
| 2,869,171 | A | 1/1959 | Levine | |
| 2,876,834 | A | 3/1959 | Walker | |
| 4,055,871 | A | 11/1977 | Morton | |
| 4,733,435 | A | 3/1988 | Darner | |
| 4,733,711 | A | 3/1988 | Schon | |
| 4,776,381 | A * | 10/1988 | Riddiford | E06B 9/327 188/82.1 |
| 4,919,185 | A | 4/1990 | Comeau et al. | |
| 4,938,443 | A | 7/1990 | Rowe | |
| 5,121,893 | A | 6/1992 | King et al. | |

(Continued)

*Primary Examiner* — Abe Massad
*Assistant Examiner* — John W Hanes, Jr.
(74) *Attorney, Agent, or Firm* — Dority & Manning, P.A.

(57) ABSTRACT

A rail for a covering for an architectural opening is provided. The rail may be attachable to a shade member of the covering. The rail may include a magnet assembly that is at least partially positioned within a retention channel formed in the rail to releasably secure the rail to a head rail. The magnet assembly may be positionable along a longitudinal axis of the rail and may include a cam lock assembly that releasably secures the magnet assembly within the retention channel of the rail. According to the present disclosure, the head rail and the rail are held in close proximity to each other to inhibit the passage of light between the rail and a head rail.

16 Claims, 9 Drawing Sheets

(56) References Cited

U.S. PATENT DOCUMENTS

| | | | |
|---|---|---|---|
| 5,127,458 | A | 7/1992 | Schaefer et al. |
| D381,890 | S | 8/1997 | Levy |
| 6,065,524 | A | 5/2000 | Rossini |
| D440,099 | S | 4/2001 | Horsten |
| D440,100 | S | 4/2001 | Horsten et al. |
| D443,168 | S | 6/2001 | Horsten |
| 6,371,192 | B1 | 4/2002 | Anderson et al. |
| D488,945 | S | 4/2004 | Bibby et al. |
| D497,506 | S | 10/2004 | Nien |
| D497,758 | S | 11/2004 | Goldberg |
| 6,817,402 | B1 | 11/2004 | Fraczek et al. |
| D522,297 | S | 6/2006 | Miller et al. |
| D530,967 | S | 10/2006 | Smith |
| D542,067 | S | 5/2007 | Watkins et al. |
| D542,068 | S | 5/2007 | Watkins et al. |
| D544,422 | S | 6/2007 | Heilaneh et al. |
| D546,104 | S | 7/2007 | Miller et al. |
| 7,367,536 | B1 | 5/2008 | Anderson et al. |
| D595,078 | S | 6/2009 | Kollman et al. |
| 7,543,623 | B2 | 6/2009 | Allardyce et al. |
| D600,484 | S | 9/2009 | Anderson et al. |
| 7,694,482 | B2 | 4/2010 | Gazaway et al. |
| 8,256,489 | B2 | 9/2012 | Berger |
| D680,357 | S | 4/2013 | Wills et al. |
| 8,607,839 | B2 | 12/2013 | Berger |
| D699,976 | S | 2/2014 | Chou |
| 8,857,887 | B1 | 10/2014 | Schmeichel |
| 8,944,135 | B2 | 2/2015 | Spray |
| 9,169,691 | B2 | 10/2015 | Berger |
| D759,400 | S | 6/2016 | Watkins |
| 9,695,633 | B2 | 7/2017 | Morris |
| 9,732,555 | B2 | 8/2017 | Morris |
| 9,797,188 | B2 | 10/2017 | Rettig |
| 9,879,477 | B2 | 1/2018 | Anderson |
| 2004/0182522 | A1 | 9/2004 | Strand et al. |
| 2007/0151676 | A1 | 7/2007 | Lin |
| 2008/0202705 | A1 | 8/2008 | Cheng et al. |
| 2008/0244862 | A1 | 10/2008 | Tooyama |
| 2009/0014133 | A1 | 1/2009 | Lin |
| 2010/0083594 | A1 | 4/2010 | Gazaway et al. |
| 2010/0147469 | A1 | 6/2010 | Yu et al. |
| 2011/0023371 | A1* | 2/2011 | Lethers ..... E06B 7/32 49/478.1 |
| 2012/0234502 | A1 | 9/2012 | Chen |
| 2013/0068398 | A1 | 3/2013 | Willis et al. |
| 2013/0087296 | A1 | 4/2013 | Mullet |
| 2013/0098563 | A1 | 4/2013 | Jang |
| 2013/0105649 | A1 | 5/2013 | Willis et al. |
| 2013/0160954 | A1* | 6/2013 | Bolton, III ..... E06B 9/24 160/84.04 |
| 2013/0247472 | A1* | 9/2013 | Mentasti ..... F25D 23/087 49/478.1 |
| 2014/0048218 | A1 | 2/2014 | Ng et al. |
| 2015/0007946 | A1 | 1/2015 | Yu et al. |
| 2016/0090779 | A1 | 3/2016 | Nurre et al. |
| 2016/0123074 | A1 | 5/2016 | Anderson |
| 2016/0222721 | A1 | 8/2016 | Rettig |
| 2017/0138121 | A1 | 5/2017 | Hsu |
| 2017/0138124 | A1 | 5/2017 | Kanno |
| 2017/0159356 | A1 | 6/2017 | Anderson |
| 2018/0128046 | A1 | 5/2018 | Anderson |

* cited by examiner

RAILS FOR A COVERING FOR AN ARCHITECTURAL OPENING

CROSS-REFERENCE TO RELATED APPLICATIONS

This application is a continuation of U.S. patent application Ser. No. 15/045,319, filed on Feb. 17, 2016, the disclosure of which is hereby incorporated by reference herein in its entirety for all purposes.

TECHNICAL FIELD

The present disclosure relates generally to coverings for architectural openings, and more specifically to rails for a covering for an architectural opening.

BACKGROUND

A movable rail typically is attached to an edge of the shade member to facilitate extension of the shade member across the opening and to maintain the shade member in a desired configuration. Some movable rails loosely connect to a head rail, which tends to permit passage of light through the connection between the head rail and the movable rail. Current offerings to reduce the passage of light through the connection between the head rail and the movable rail are either difficult to manufacture, are aesthetically displeasing, or both.

The present disclosure generally provides at least one rail for a covering for an architectural opening that offers improvements or an alternative to existing arrangements.

BRIEF SUMMARY

The present disclosure generally provides a rail, such as a movable rail, that is attachable to a shade member of a covering for an architectural opening. The movable rail includes a magnet assembly that is at least partially positioned within a retention channel formed in the movable rail to releasably secure the movable rail to a head rail. The magnet assembly is releasably secured within the retention channel by a cam lock assembly. According to the present disclosure, a tight interference is achieved between the head rail and the movable rail to inhibit the passage of light between the movable rail and head rail when the head rail and the movable rail are connected together.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings, which are incorporated into and constitute a part of the specification, illustrate embodiments of the disclosure and, together with the general description above and the detailed description below, serve to explain the principles of these embodiments.

DETAILED DESCRIPTION

Figure 1:
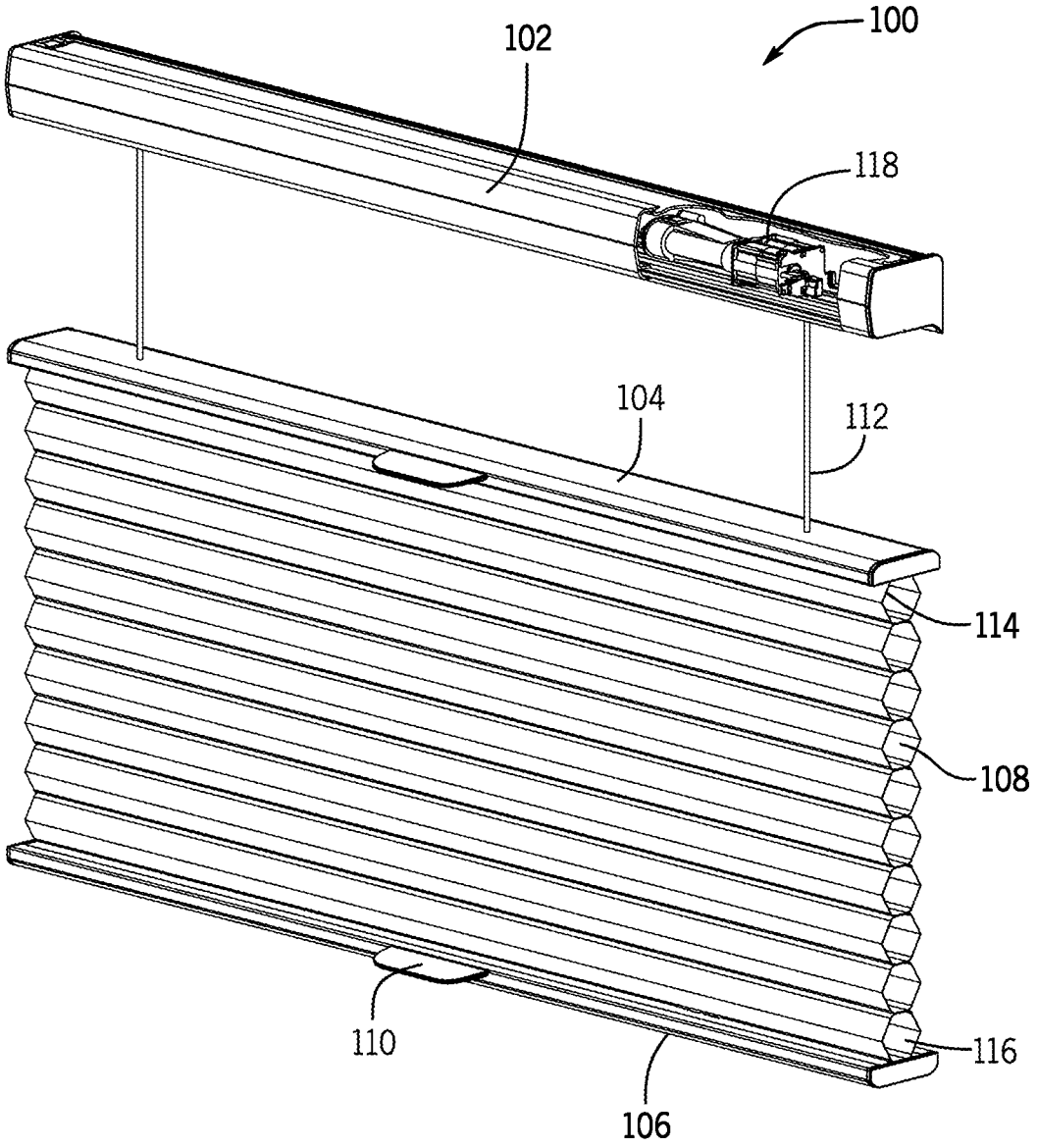
FIG. 1 is a front view of a covering in an extended, partially open configuration in accordance with an embodiment of the present disclosure.

FIG. 1 is a front view of an illustrative embodiment of a movable rail utilizing at least one selectively positionable magnet assembly to releasably secure the movable rail to adjacent components of an architectural covering (e.g., to a gasket member received at least partially within a head rail of the covering). In the exemplary embodiment of FIG. 1, a covering 100 is shown in a fully extended, partially open configuration in accordance with some embodiments of the present disclosure. In one embodiment, the covering 100 includes a head rail 102, a movable rail 104, a bottom rail 106, a shade member 108 extending between the movable rail 104 and the bottom rail 106, and a handle 110 secured to at least one of the movable rail 104 and the bottom rail 106. A pair of lift cords 112 extends from the head rail 102 and is connected to at least one of the movable rail 104 and the bottom rail 106. The movable rail 104, which may be referred to as a top rail or a first rail, extends horizontally along and is attached to a first portion 114 (e.g., an upper portion) of the shade member 108. The bottom rail 106, which may be referred to as a second rail, extends horizontally along and is attached to a second portion 116 (e.g., a lower portion) of the shade member 108. As explained in detail below, the covering 100 may be configured to generally eliminate sight lines and/or light gaps at lines of connection between adjacent components of the covering 100 (e.g., between the head rail 102 and the movable rail 104) for a desired aesthetic and/or functional characteristic. In one embodiment, separate and independent from the aforementioned embodiments yet combinable therewith with desired, a magnetic element may be associated with at least one of the head rail 102 and the movable rail 104 to pull the movable rail 104 into a closed position adjacent the head rail 102 (see FIG. 10), as described in more detail hereafter.

In the illustrative embodiment shown in FIG. 1, the movable rail 104 and the bottom rail 106 move towards and away from the head rail 102 independently from each other to any desired position in an architectural opening, and to any desired amount of coverage of the opening. The movable rail 104 is positioned between the head rail 102 and the shade member 108 and functions to open and close the shade member 108 by moving the first portion 114 of the shade member 108 away from and towards the head rail 102, respectively. The bottom rail 106 may be configured to be substantially identical to the movable rail 104 and to be substantially symmetrical to the movable rail 104, where the bottom rail 106 and the movable rail 104 have substantially mirrored configurations across the shade member 108. Additionally or alternatively, the bottom rail 106 functions to extend and retract the shade by moving the second portion 116 of the shade member 108 away from and towards the head rail 102, respectively. As explained below, the covering 100 of FIG. 1 includes a drive mechanism 118 configured to raise or retract at least one of the movable rail 104 and the bottom rail 106 through, for example, the lift cords 112 extending adjacent, along, or through the shade member 108 (see FIGS. 10 and 11). The drive mechanism 118 may include a drive pulley and an operating element, one or more electric motors, or other suitable drive mechanism(s) as known to those of ordinary skill in the art.

Figure 2:
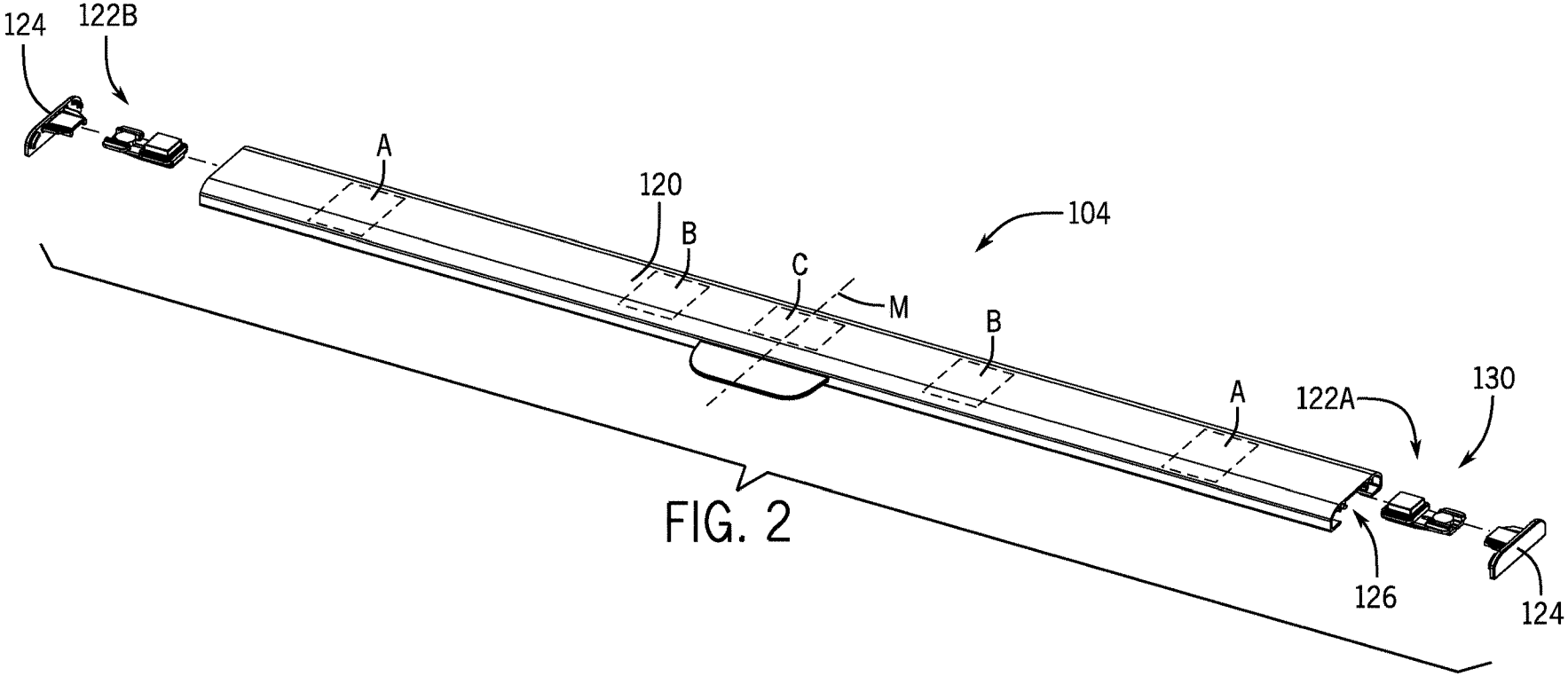
FIG. 2 is a front exploded view of a movable rail in accordance with an embodiment of the present disclosure.

FIG. 2 is a front exploded view of an illustrative embodiment of the movable rail 104 in accordance with principles of the present disclosure. As shown, the movable rail 104 includes a rail member 120, one or more magnet assemblies (e.g., a first magnet assembly 122A and a second magnet assembly 122B, which may be referred to as magnetic elements individually or collectively) positioned within the rail member 120. A pair of end caps 124 preferably are provided, configured to cover the ends of the rail member 120. The rail member 120 is an elongate bar including, in part, a retention channel 126 formed therein and sized to receive at least a portion of the magnet assemblies 122A, 122B. For example, the retention channel 126 may be formed on an interior surface 128 of the rail member 120 along a longitudinal axis of the rail member 120 (see FIG. 3). The magnet assemblies 122A, 122B are positionable along the longitudinal axis of the rail member 120 at least partially within the retention channel 126.

Figure 3:
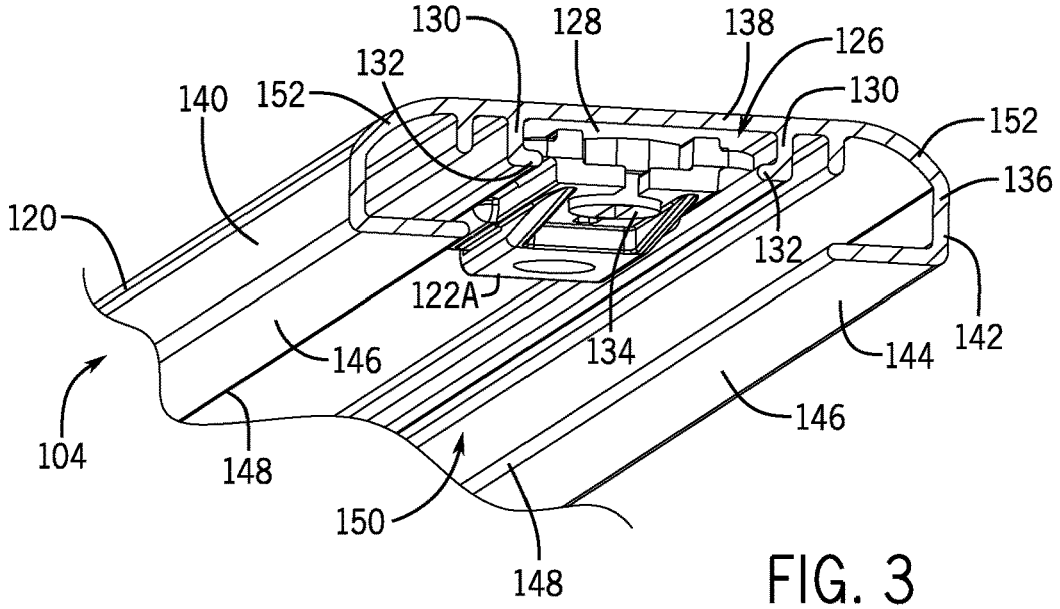
FIG. 3 is a fragmentary bottom view of the movable rail of FIG. 2 in accordance with an embodiment of the present disclosure.

In the illustrative embodiment of FIG. 3, the retention channel 126 includes opposing projections, such as ribs 130 with inwardly projecting tabs 132, that constrict an opening of the retention channel 126 to inhibit removal of the magnet assemblies 122A, 122B through the opening. The opposing projections may extend continuously lengthwise along the length of the rail member 120 along edges of the retention channel 126 (see FIG. 3). As described below, the magnet assemblies 122A, 122B may be sized to fit snugly within the retention channel 126, and in some embodiments, the magnet assemblies 122A, 122B may be selectively secured within the retention channel 126, at desired locations, by a releasable lock mechanism (e.g., a cam lock assembly or mechanism 134) actuatable to secure the magnet assemblies 122A, 122B in a desired position along a length of the movable rail 104. For example, the magnet assemblies 122A, 122B may be secured within the retention channel 126 via the lock mechanism at factory preset locations before attachment of the shade member 108 to the movable rail 104. In some embodiments, a user or customer may adjust the position of the magnet assemblies 122A, 122B via the releasable lock mechanism after removing the shade member 108 from the movable rail 104, though such is not an essential feature of the present disclosure. In some embodiments, the magnet assemblies 122A, 122B may be fixedly secured to the rail member 120, whether within or outside the retention channel 126, by a securing device, such as a screw or other fastener. When assembled, the retention channel 126 and the magnet assemblies 122A, 122B preferably are substantially hidden from at least a front elevation view of the shade member 108 during operation of the covering 100. Although the movable rail 104 is described in the disclosure, the bottom rail 106 may be similarly configured.

With reference to FIG. 2, the magnet assemblies 122A, 122B in an exemplary embodiment may be positioned in spaced apart locations within the retention channel 126 of the rail member 120, or may be positioned adjacent to one another, or even positioned side by side along the length of the rail member 120. In embodiments having a plurality of magnet assemblies (e.g., the first magnet assembly 122A and the second magnet assembly 122B), the magnet assemblies 122A, 122B may be spaced uniformly or non-uniformly along the length of the rail member 120. The magnet assemblies may also be positioned with reference to a feature of the covering 100, such as a set distance from either of the ends of the rail member 120 (see locations "A" in FIG. 2). The magnet assemblies 122A, 122B may be positioned nearer a center of the movable rail 104, either symmetrically relative to a midline M of the rail 104, or asymmetrically (see locations "B" in FIG. 2). Additionally or alternatively, a distance between the first and second magnet assemblies 122A, 122B may be greater than a distance between one of the magnet assemblies 122A, 122B and an end of the rail member 120 (see locations "A" in FIG. 2). In embodiments having a single magnet assembly (e.g., the first magnet assembly 122A), the first magnet assembly 122A may be positioned at any one of a plurality of locations along the rail 104, such as being centered along the length of the movable rail 104 (see location "C" in FIG. 2).

In one embodiment, the magnet assemblies 122A, 122B may provide ballast weight to the movable rail 104 and/or snugly secure the movable rail 104 to the head rail 102. As a ballast weight, the magnet assemblies 122A, 122B may provide desired characteristics to the covering 100, such as limiting unintentional movement (e.g., swaying) of the movable rail 104 within the architectural opening under light load conditions (e.g., a gentle breeze or slight contact with an adjacent covering or other objects). As a securing means, the magnet assemblies 122A, 122B create a magnetic force to releasably hold the movable rail 104 and the head rail 102 together, as more fully explained below. For example, in horizontal applications, the magnet assemblies 122A, 122B may limit sagging of the movable rail 104 across its width by maintaining the movable rail 104 in close adjacent relationship with the head rail 102, especially in applications where the movable rail 104 spans a wide architectural opening.

FIG. 3 is a fragmentary bottom view of an illustrative embodiment of the movable rail 104 in accordance with the principles of the present disclosure. In the embodiment of FIG. 3, the retention channel 126 extends lengthwise along the length of the rail member 120, and in some embodiments, may extend along the entire length of the rail member 120. At least one of the first magnet assembly 122A and the second magnet assembly 122B may be selectively slidable within the retention channel 126 along the length of the rail member 120 toward either end of the rail member 120. By moving one or more of the magnet assemblies 122A, 122B along the length of the retention channel 126, a user can adjust or select the attachment characteristics between the movable rail 104 and the head rail 102 to, for example, maintain the movable rail 104 in close adjacent relationship with the head rail 102 in a horizontal orientation substantially across a width dimension of the architectural opening. In this manner, the magnet assemblies 122A, 122B may function to reduce the presence of a light gap between the movable rail 104 and the head rail 102 such as by holding the movable rail 104 and the head rail 102 close to each other, thereby reducing light gaps therebetween. For example, the magnet assemblies 122A, 122B may maintain the movable rail 104 adjacent to the head rail 102 should the movable rail 104 drift, such as laterally, relative to the head rail 102. Additionally or alternatively, the magnet assemblies 122A, 122B may maintain the movable rail 104 adjacent to the head rail 102 when a user pulls the bottom rail 106 away from the head rail 102 to open the shade member 108, for instance. In some embodiments, selective movement of the magnet assemblies 122A, 122B may also allow the user to address localized issues that may affect securement of the movable rail 104 to the head rail 102, such as wind or physical interference caused by other shades or drapes.

As shown in FIG. 3, the rail member 120, which may be formed of extruded aluminum or another thermoformable material, has a generally rectangular cross-section (e.g., an inverted U-shape cross-section) with a low aspect ratio of height to depth such that the rail member 120 is considered long, thin, and deep. As illustrated, the rail member 120 is formed by a wall 136 defining a top face 138, a front face 140, a rear face 142, and a bottom face 144. The bottom face 144 includes opposing flanges 146 extending substantially along the length of the rail member 120, each flange 146 having an inner edge 148, and forming a slot 150 therebetween for receipt of the shade member 108. In an exemplary embodiment, the wall 136 includes arcuate transition regions 152 between the top face 138 and each of the front face 140 and the rear face 142. In some embodiments, the portion of the top face 138 extending between the transition regions 152 is generally planar, but may be curved convexly or concavely if desired. In the embodiment of FIG. 3, the opposing projections (i.e., ribs 130 and inwardly projecting tabs 132) are positioned inwardly between the opposing flanges 146 to locate the retention channel 126 centrally relative to the depth of the rail member 120 between the front face 140 and the rear face 142. However, depending on desired engagement characteristics of the movable rail 104 with the head rail 102, the position of the retention channel 126 can be moved closer to one of the front face 140 and the rear face 142. Additionally or alternatively, the position of the retention channel 126 may vary in location along the length of the rail member 120.

To secure the magnet assemblies 122A, 122B to the rail member 120, each of the magnet assemblies 122A, 122B may include a cam lock assembly 134 to allow, in a first actuation position, selective engagement with the ribs 130 of the retention channel 126 to fix, by a sufficient friction force, the location of the magnet assemblies 122A, 122B in the retention channel 126. The cam lock assembly 134 may be changed to a second actuation position, where the cam lock assembly 134 disengages from the ribs 130 to sufficiently reduce the friction force and allow the magnetic assemblies 122A, 122B to be moved along the retention channel 126 to another (or same) desired position.

Figure 4:
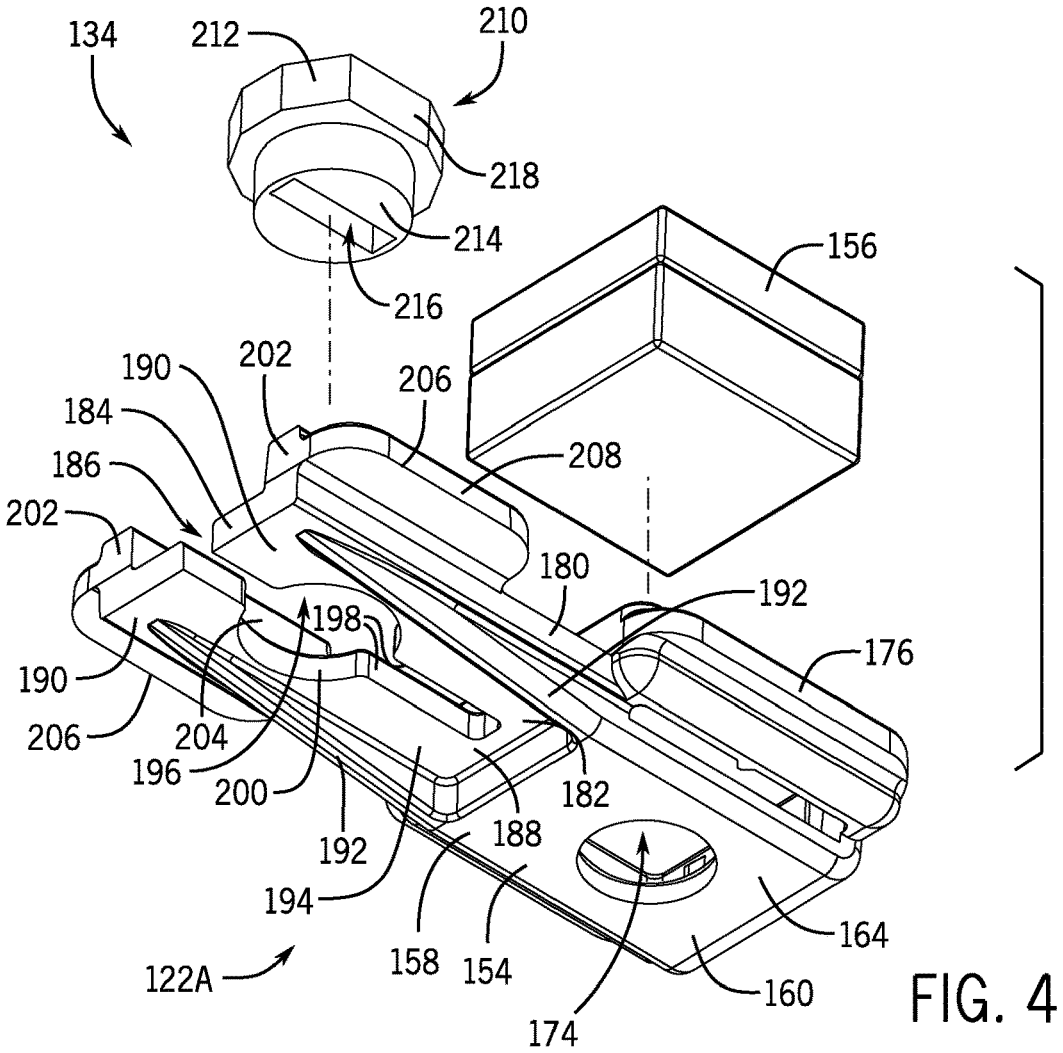
FIG. 4 is a bottom exploded view of a magnet assembly in accordance with an embodiment of the present disclosure.
Figure 5:
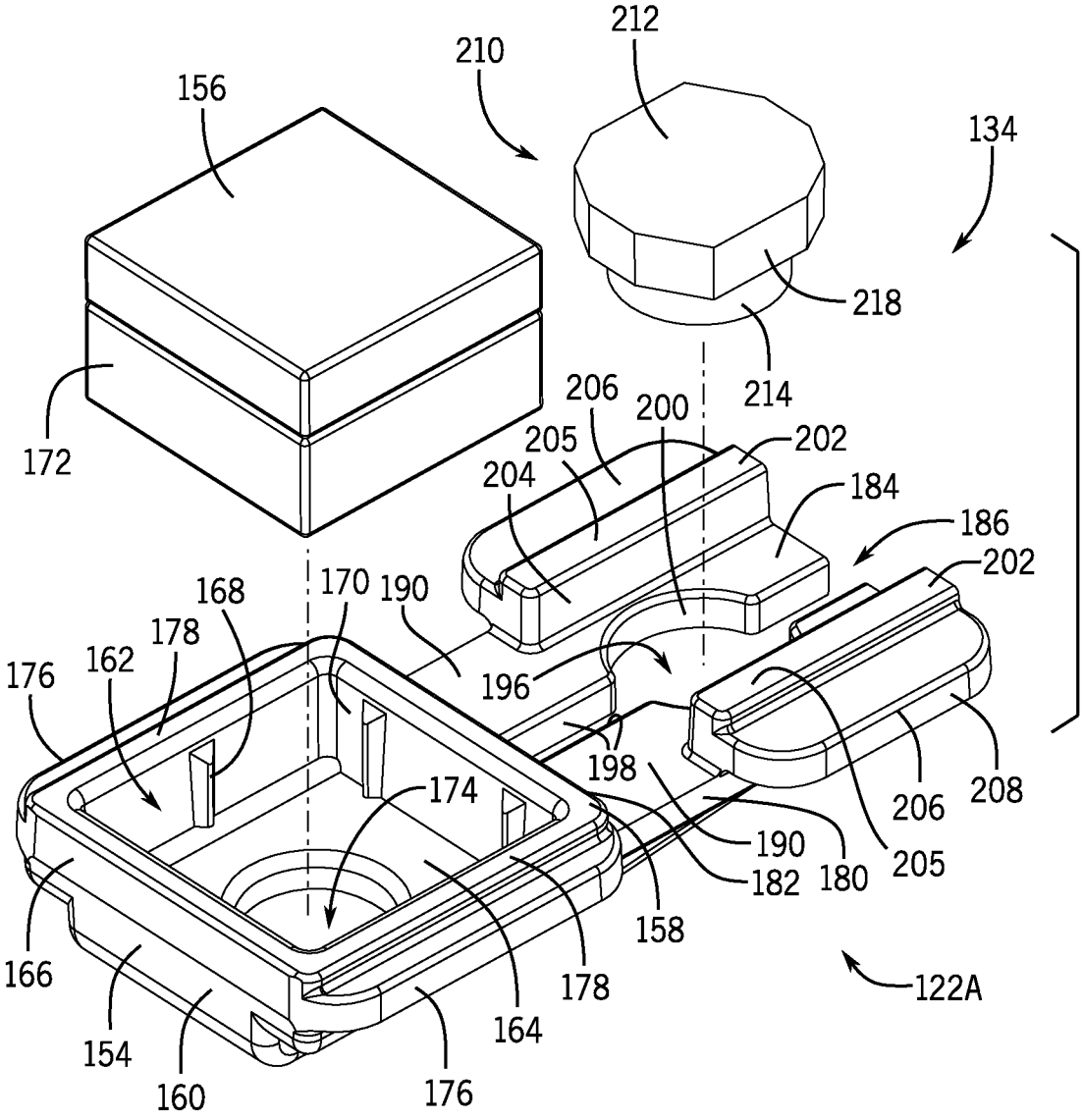
FIG. 5 is a top exploded view of the magnet assembly of FIG. 4 in accordance with an embodiment of the present disclosure.
Figure 6:
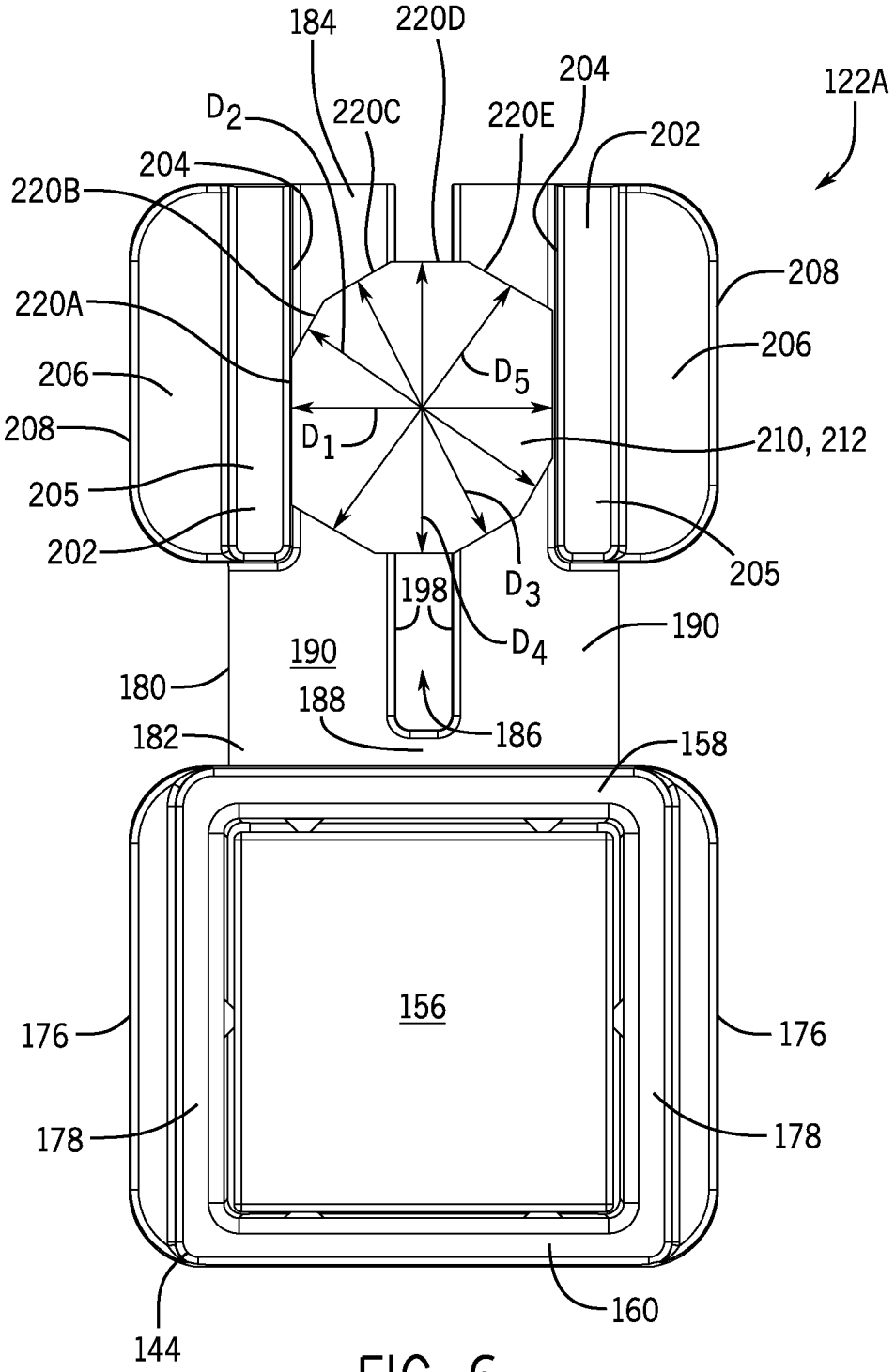
FIG. 6 is a top plan view of the magnet assembly of FIG. 5 in accordance with an embodiment of the present disclosure.

FIG. 4 is a bottom exploded view of an illustrative embodiment of the first magnet assembly 122A, including the cam lock assembly 134, in accordance with principles of the present disclosure. FIG. 5 is a top exploded view of an embodiment of the first magnet assembly 122A, including the cam lock assembly 134, in accordance with principles of the present disclosure. FIG. 6 is a bottom view of the first magnet assembly 122A, including the cam lock assembly 134, in accordance with principles of the present disclosure. FIGS. 4-6 and their associated description below describe the first magnet assembly 122A, and the second magnet assembly 122B may be similarly configured. As illustrated in FIGS. 4-6, the first magnet assembly 122A is slidably positioned in the retention channel 126, with either end of the first magnet assembly 122A being inserted first (see FIG. 3), and includes a base member 154, the cam lock assembly 134 operably associated with the base member 154, and a magnet member 156 connected to the base member 154. The base member 154 has a first end 158 and a second end 160 opposite the first end 158. The base member 154 is generally cuboid in shape and sized for slidable receipt within the retention channel 126.

With reference to FIG. 5, the base member 154 defines, in one embodiment, a generally cuboid magnet cavity 162 sized to receive the magnet member 156. The magnet cavity 162 may be defined by a bottom wall 164 and a perimeter wall 166 extending upwardly from the bottom wall 164. The magnet member 156 may be secured, permanently or releasably, in the magnet cavity 162 in many different manners, such as by being clamped, interference fit, glued, or otherwise secured within the magnet cavity 162. For example, the magnet cavity 162 may include a plurality of ribs 168 formed on and extending away from an interior surface 170 of the perimeter wall 166 to frictionally engage sidewalls 172 of the magnet member 156 and maintain the magnet member 156 within the magnet cavity 162. To remove the magnet member 156 from the magnet cavity 162, the base member 154 may include a first aperture 174 defined within the bottom wall 164 through which a user may push the magnet member 156 out of the magnet cavity 162.

With continued reference to the exemplary embodiments of FIGS. 4-6, the base member 154 may include guide members 176 extending from opposing sidewalls 178. In the illustrative embodiments of FIGS. 4-6, each guide member 176 is captured between the top face 138, the rib 130, and the tab 132 of the rail member 120 to keep the magnet assembly 122A retained, but selectively slidable, within the retention channel 126 (see FIGS. 3 and 9). The guide members 176 may be dimensioned to slidably abut the respective ribs 130 to which they are adjacent, or may form a gap between the opposing guide members 176 and the ribs 130 (but not a gap that would allow the magnet assembly 122A to be removed through the opening of the retention channel 126 defined between the tabs 132). Likewise, each opposing guide member 176 may be dimensioned to engage both the tab 132 and the top face 138 of the rail member, or may form a gap therebetween.

As illustrated in FIGS. 4-6, the cam lock assembly 134 may be at least partially integrally formed with the base member 154, and extend away from the first end 158 thereof. The cam lock assembly 134 includes a plank member 180 having a proximal end 182 formed at the intersection with the first end 158 of the base member 154, and extending substantially across the width of the base member 154. The plank member 180 has a free distal end 184 opposite the proximal end 182 such that the plank member 180 is cantilevered from the first end 158 of the base member 154.

In one embodiment, a slot 186 is formed in the plank member 180 and extends from the distal end 184 towards the proximal end 182, and terminates just short of the engagement of the proximal end 182 with the first end 158 of the base member 154, leaving a small central portion 188 of the plank member 180. The slot 186 defines a beam 190 from each of the lateral sides of the plank member 180, each of the opposing beams 190 extending between the proximal end 182 and the distal end 184 of the plank member 180. The slot 186 extends generally along the centerline of the plank member 180, with the opposing beams 190 having the same or similar width and length. The slot 186 may also extend along the longitudinal centerline of the base member 154. A support rib 192 may extend along a bottom surface 194 of each beam 190, from the first end 158 of the base member 154 towards the distal end 184 of each of the opposing beams 190. The support rib 192 may decreasingly taper in height along its length, such as decreasing in height with distance away from the first end 158 of the base member 154. In some embodiments, the slot 186 bisects a second aperture 196 formed between inner edges 198 of each of the beams 190. The second aperture 196 may be defined by sidewalls 200 formed of the opposing beams 190 and generally define a circular periphery. As shown in FIG. 5, for instance, a wall 202 extends along an outer edge of each beam 190, from approximately the mid-point of the length of each beam 190 between the proximal end 182 to the distal end 184. Each wall 202 extends about one-half the width of each beam 190, but does not intersect the periphery of the second aperture 196. Each wall 202 defines an inner engagement surface 204, an upper surface 205, and an extension member 206 projecting laterally outwardly from the wall 202. The lateral extension members 206 may have a length the same as or similar to the wall 202, or may be shorter or longer as desired. Each extension member 206 defines an outer engagement surface 208 for selective slidable or fixed engagement with the ribs 130 of the retention channel 126. The combination of the beam 190, the inner engagement surface 204, and outer engagement surface 208 is considered a "beam assembly." In some embodiments, the inner engagement surface 204 and the outer engagement surface 208 may be formed on the beams 190 themselves. In such embodiments, the base member 154 may not include the walls 202 or the lateral extension members 206.

The opposing beams 190 are shown having a rectangular section, but are not limited to this shape. The opposing beams 190 are acted upon by a cam mechanism, for example a knob 210, to bias laterally outwardly to cause engagement of the outer engagement surface 208 with the respective ribs 130. In the exemplary embodiments of FIGS. 4-6, the beam assemblies are forced laterally apart by the knob 210 and resiliently return to a closer spacing when a dimension of the knob 210 is reduced, as explained in more detail below. The terminal end of the slot 186 may be rounded in order to reduce any stress risers that may occur when the beam assemblies are resiliently biased away from one another by the knob 210.

With continued reference to FIGS. 4-6, the knob 210 includes a top portion 212 and a bottom portion 214. The bottom portion 214 may be cylindrically-shaped and sized for rotational receipt within the second aperture 196. As shown in FIG. 4, a tool engagement feature 216 is defined within the bottom portion 214 of the knob 210. The tool engagement feature 216, which may be a slot or a bolt head, is sized to receive a corresponding tool to rotate the knob 210 to cause the beam assemblies to bias laterally outward, as described below. The top portion 212 includes an upper surface, a bottom surface, and a faceted sidewall 218 extending between the upper surface and the bottom surface. As explained below, the faceted sidewall 218 is positioned for engagement with the opposed inner engagement surfaces 204 of the respective walls 202.

As best seen in FIG. 6, the faceted sidewall 218 includes a plurality of diametrically opposed, planar surface sets 220 defining successively increased dimensions of the top portion 212. For example, the faceted sidewall 218 may include a first surface set 220A defining a first diameter $D_1$ of the top portion 212, a second surface set 220B defining a second diameter $D_2$ of the top portion 212, a third surface set 220C defining a third diameter $D_3$ of the top portion 212, a fourth surface set 220D defining a fourth diameter $D_4$ of the top portion 212, and a fifth surface set 220E defining a fifth diameter $D_5$ of the top portion 212. The diameters $D_1$, $D_2$, $D_3$, $D_4$, $D_5$ may be successively sized such that the fifth diameter $D_5$ is greater than the fourth diameter $D_4$, the fourth diameter $D_4$ is greater than the third diameter $D_3$, the third diameter $D_3$ is greater than the second diameter $D_2$, and the second diameter $D_2$ is greater than the first diameter $D_1$.

As shown in FIG. 6, each of the surface sets 220 engages the opposed inner engagement surfaces 204 of the respective walls 202 of the base member 154 to define the position (e.g., bending) of the beams 190 relative to each other. In one embodiment, the beams 190 bend laterally relative to each other in a plane defined by the width of the beams 190. For example, engagement of the first surface set 220A with the opposing inner engagement surfaces 204 of the walls 202 defines a first, or minimal, deflected position of the beams 190. Engagement of the second surface set 220B with the opposing inner engagement surfaces 204 of the walls 202 defines a second deflected position of the beams 190. Engagement of the third surface set 220C with the opposing inner engagement surfaces 204 of the walls 202 defines a third deflected position of the beams 190. Engagement of the fourth surface set 220D with the opposing inner engagement surfaces 204 of the walls 202 defines a fourth deflected position of the beams 190, and engagement of the fifth surface set 220E with the opposing inner engagement surfaces 204 of the walls 202 defines a fifth deflected position of the beams 190. In the first deflected position, the first magnet assembly 122A may be slid within the retention channel 126. In the second through fifth positions, the lateral deflection of the beams 190 causes increased frictional engagement of the lateral extension members 206 with the ribs 130 of the retention channel 126, resulting in the first magnet assembly 122A being effectively locked within the retention channel 126. In each of the first through fifth deflected positions, increased levels of friction between the first magnet assembly 122A and the retention channel 126 is caused by increased deflection of the beam assemblies by the knob 210. In some embodiments, elastic deformation of the beams 190 may occur through lateral bending of the beams 190 in the first through fifth deflected positions such that the beam assemblies resiliently return to a static position without permanent deformation. Additionally or alternatively, portions of the beams 190 may be received within detents formed in the ribs 130 of the retention channel 126 to position the first magnet assembly 122A at predetermined locations. In some embodiments, the outer engagement surfaces 208 of the lateral extension members 206 may be non-linear (e.g., curved, serrated, etc.) to create higher friction forces and permit the first magnet assembly 122A to be used in non-linear retention channels 126. The multiple increasing displacement diameters $D_1$, $D_2$, $D_3$, $D_4$, $D_5$ may allow the first magnet assembly 122A to be used in various sized retention channels 126 and/or movable rails 104.

Upon rotation of the knob 210 in a first rotational direction (e.g., counter clockwise in FIG. 8), the beams 190 increasingly deflect outwardly through the first through fifth deflected positions, which in turn causes the outer engagement surfaces 208 of the first magnet assembly 122A to frictionally engage the ribs 130 of the retention channel 126, for instance. For example, in the second deflected position of the beams 190, the second surface set 220B of the knob 210 engages the inner engagement surfaces 204 of the walls 202 to cause the beams 190 to laterally deflect outward for sufficient frictional engagement with the retention channel 126. Each successive diameter of the knob 210 causes further deflection of the beams 190 for increased friction and/or to accommodate retention channels 126 having wider-spaced ribs 130. In such embodiments, rotation of the knob 210 in the first rotational direction increases the distance between the lateral extension members 206 to frictionally lock the first magnet assembly 122A within the retention channel 126 of the rail member 120. To disengage the first magnet assembly 122A within the retention channel 126, the knob 210 is rotated in a second opposite rotational direction (e.g., clockwise in FIG. 8) to decrease the outward deflection of the beams 190. Because the surface sets 220 are planar, the position of the knob 210 and the deflected positions of the beams 190 are effectively locked or otherwise maintained until the knob 210 is rotated further in the first rotational direction or in the second rotational direction. Although described as having five surface sets 220, the knob 210 may include any number of suitable surface sets 220 (e.g., less than or more than five) to extend and/or collapse the extension members 206 of the first magnet assembly 122A. As noted above, the knob 210 may be rotationally displaced by a tool (e.g., a screwdriver, a hex key, etc.) positioned within the tool engagement feature 216 of the bottom portion 214 of the knob 210 and rotated in either the first rotational direction or the second rotational direction.

Figure 7:
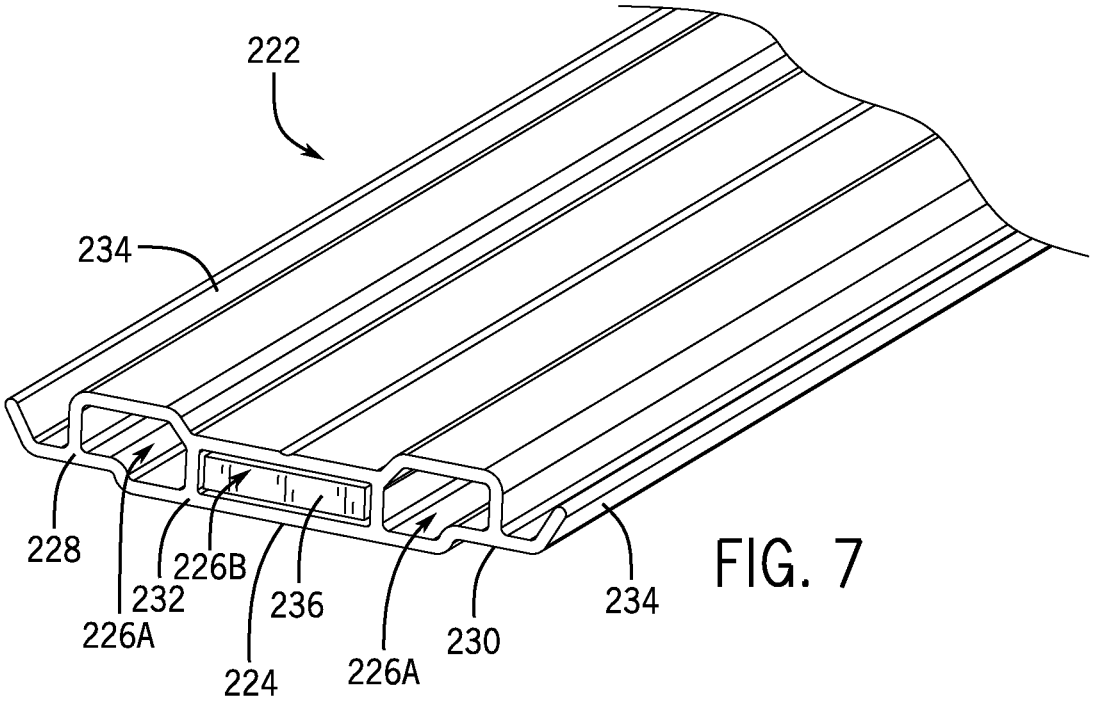
FIG. 7 is a fragmentary top view of a gasket member in accordance with an embodiment of the present disclosure.
Figure 8:
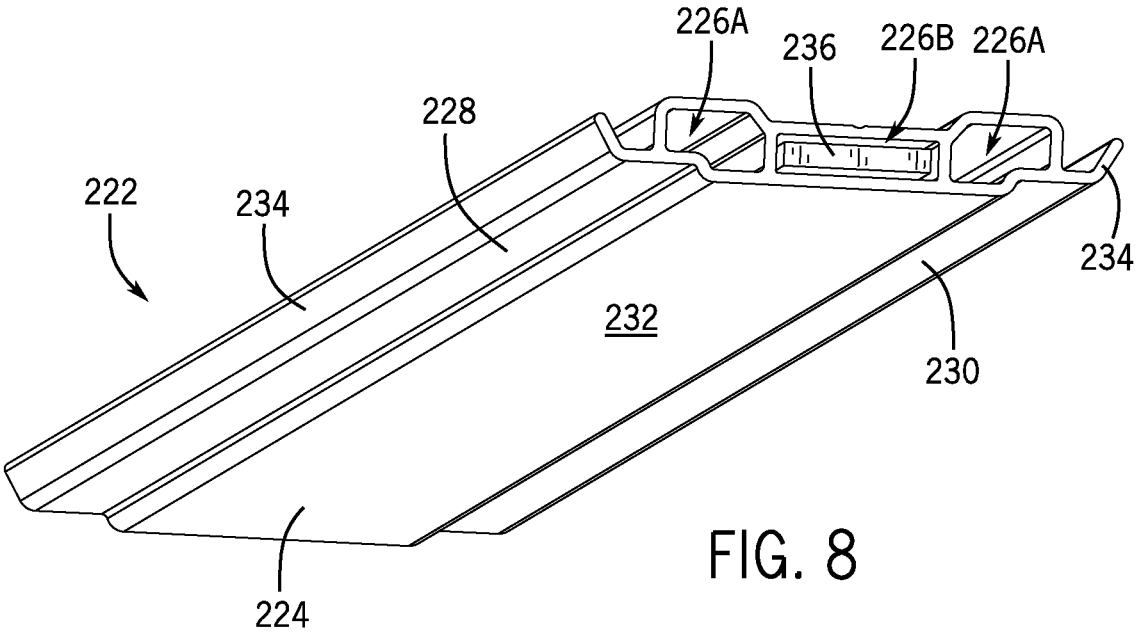
FIG. 8 is a fragmentary bottom view of the gasket member of FIG. 7 in accordance with an embodiment of the present disclosure.

FIG. 7 is a fragmentary top view of an illustrative embodiment of a gasket member 222 in accordance with the principles of the present disclosure. FIG. 8 is a fragmentary bottom view of an illustrative embodiment of the gasket member 222 in accordance with the principles of the present disclosure. As explained hereafter, the gasket member 222 of FIGS. 7 and 8 may facilitate the releasable positioning of the movable rail 104 adjacent to the head rail 102. For example, in one embodiment the gasket member 222 may serve to carry or to position a magnet 236 in the head rail 102 to interact with the magnet assemblies 122A, 122B positioned in the movable rail 104 to releasably secure the movable rail 104 to the head rail 102. The magnet 236, which in some embodiments may simply be a ferrous material, may generally be an elongate, rectilinear bar having a generally rectangular cross-section sized to fit snugly within a portion of the gasket member 222. The length of the magnet 236 need not extend the full length of the gasket member 222, but, in some embodiments, the magnet 236 extends the full length of the gasket member 222 such that the movable rail 104 may be secured to the head rail 102 irrespective of the position of the magnet assemblies 122A, 122B within the movable rail 104. Although a single magnet 236 is depicted, it should be appreciated that multiple magnets of various sizes and profiles may be utilized to provide a desired magnetic force between the gasket member 222 and the movable rail 104. In such embodiments, the multiple magnets are positioned within the gasket member 222 in substantial alignment with the magnet assemblies 122A, 122B. In some embodiments, the magnet(s) 236 may be attached to the head rail 102 without use of the gasket member 222. For example, the magnet(s) 236 may be attached to the head rail 102, such as through adhesive, tape, or mechanical fasteners. In such embodiments, the gasket member 222 may be optional such that the gasket member 222 may be omitted without departing from the spirit and scope of the present disclosure.

As illustrated in FIGS. 7 and 8, the gasket member 222 in one embodiment is an elongate member having a length extending along the length of engagement between the movable rail 104 and the head rail 102. The gasket member 222, which is positioned at least partially within the head rail 102, includes a bottom wall 224, which may have a stepped profile. A plurality of longitudinally extending cavities (e.g., two outer cavities 226A and a central cavity 226B) may extend lengthwise along the length of the gasket member 222. The cavities 226A, 226B may be defined at least in part by the bottom wall 224 and function to at least increase the torsional rigidity of the gasket member 222. In some embodiments, the magnet 236 may be received at least partially with one of the cavities 226A, 226B, such as the central cavity 226B. The bottom wall 224 may include a planar front portion 228, a planar rear portion 230, and a planar intermediate portion 232 positioned between and interconnecting the front and rear portions 228, 230. The front and rear portions 228, 230 are offset a distance from the intermediate portion and may reside within a common plane parallel to the plane of the intermediate portion 232. In some embodiments, a flange 234 may extend from an end of the front and rear portions 228, 230 to help position the gasket member 222 within the head rail 102, as described below. As shown, each flange 234 extends upwardly and may extend at an angle towards or away from the longitudinal centerline of the gasket member 222.

Figure 9:
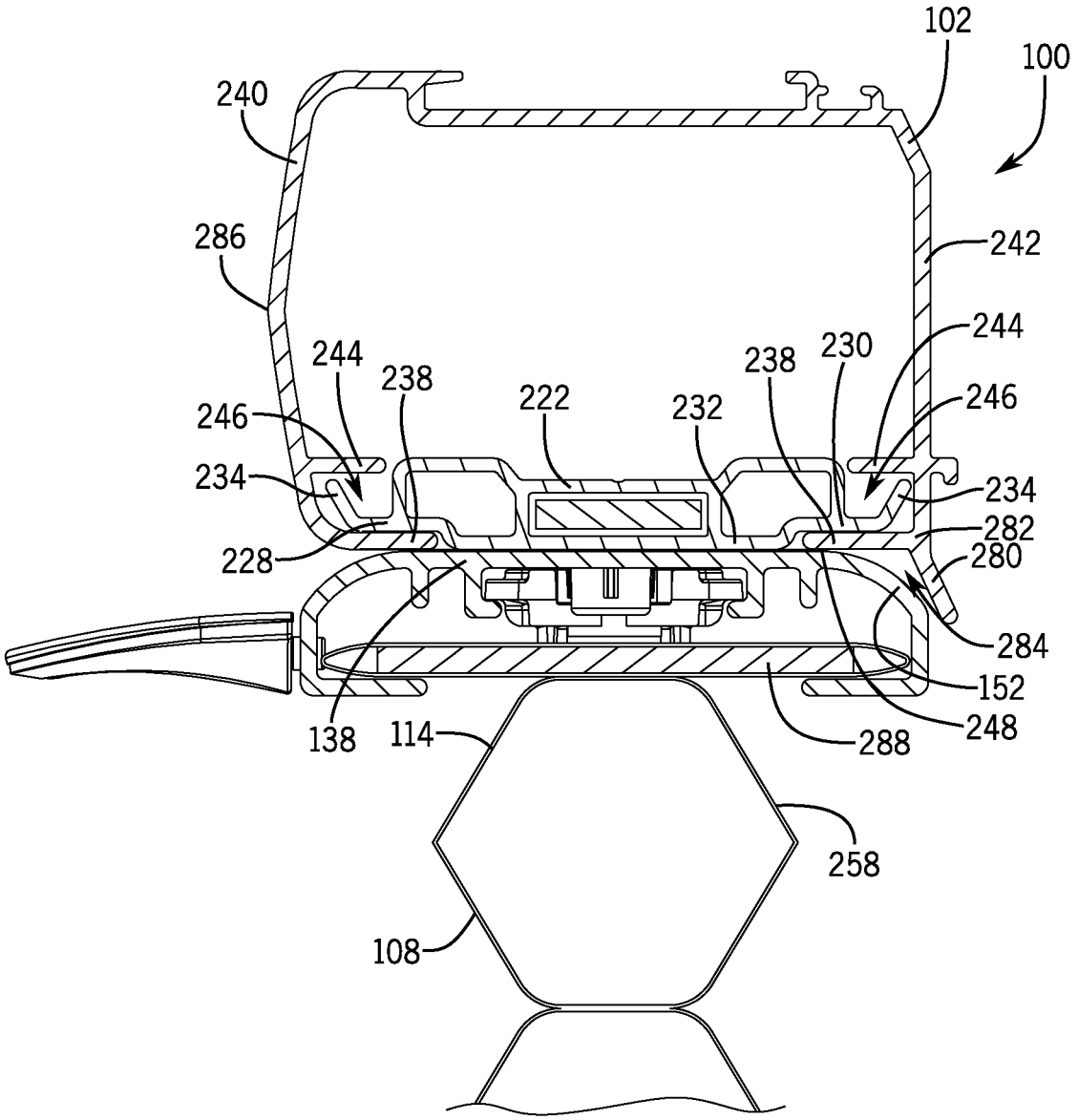
FIG. 9 is an enlarged, fragmentary right side elevation view of the covering of FIG. 1 showing the shade member in an extended, closed configuration in accordance with an embodiment of the present disclosure. The end caps and drive mechanism are not shown for discussion purposes.

FIG. 9 is an enlarged, fragmentary right side elevation view of an illustrative embodiment of the covering 100 showing the shade member 108 in an extended, closed configuration in accordance with principles of the present disclosure. The head rail 102 of FIG. 9 includes opposing tabs 238 extending inwardly from a bottom portion of respective front and rear walls 240, 242 of the head rail 102 to define a lower opening within the bottom of the head rail 102. As illustrated, the head rail 102 includes opposing securing tabs 244 extending inwardly from the front and rear walls 240, 242 parallel to and at a vertically-spaced relationship with the opposing tabs 238. Together, the tabs 238 and the securing tabs 244 define opposing grooves 246 extending lengthwise along the length of the head rail 102 and across the lower opening of the head rail 102.

With continued reference to FIG. 9, the gasket member 222 of an exemplary embodiment is positioned along the bottom of the head rail 102 and at least partially within the opposing grooves 246. In such embodiments, the gasket member 222 spans the lower opening defined between the opposing grooves 246, with the intermediate portion 232 exposed through the lower opening to substantially hide or otherwise conceal an interior of the head rail 102 from view. As shown, the opposing tabs 238 constrict the lower opening of the head rail 102 to inhibit removal of the gasket member 222 through the lower opening. For example, to position the gasket member 222 within the opposing grooves 246, the front and rear portions 228, 230 of the gasket member 222 bear against the opposing tabs 238 of the head rail 102. Additionally or alternatively, the flanges 234 of the gasket member 222 are positioned within the opposing grooves 246 and extend between the opposing tabs 238 and the securing tabs 244 to limit movement of the gasket member 222 relative to the head rail 102. Once the gasket member is positioned within the head rail 102, the intermediate portion 232 of the gasket member 222 may sit substantially flush with a bottom surface of the opposing tabs 238 to define a relatively planar bottom surface of the head rail assembly, although it is contemplated that the intermediate portion 232 may be greater or less than flush. In such embodiments, the top face 138 of the movable rail 104 may be configured to correspondingly match the bottom surface of the head rail assembly, both in length and in cross section. As such, a close positioning or mating is achieved at a line of connection 248 between the head rail 102 and/or the gasket member 222 and the movable rail 104 to inhibit passage of light between the movable rail 104 and head rail 102 when the movable rail 104 is connected to the head rail 102.

Figure 12:
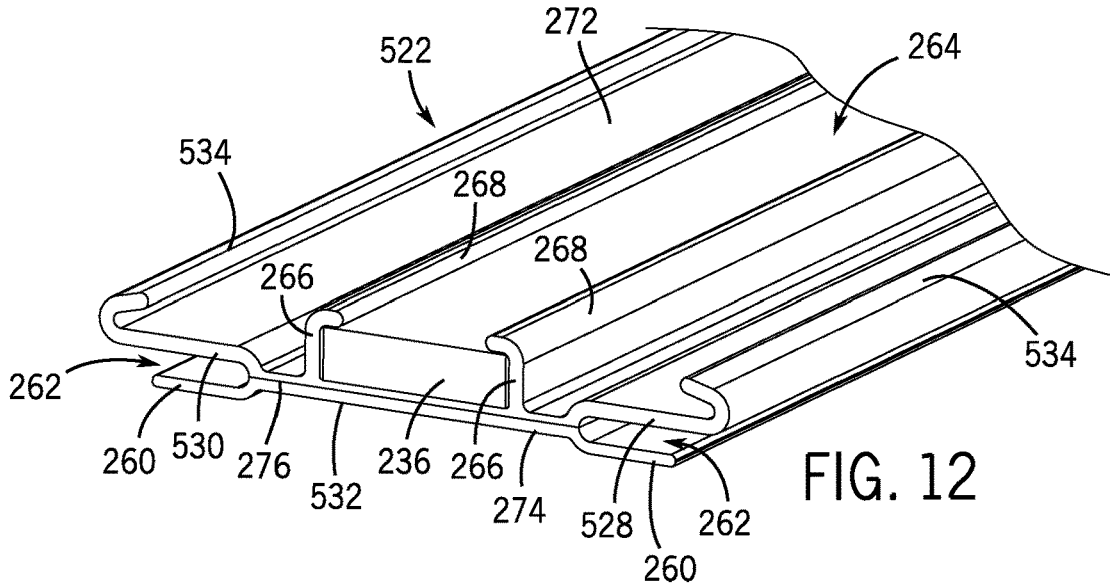
FIG. 12 is a fragmentary top view of an additional gasket member in accordance with an embodiment of the present disclosure.
Figure 13:
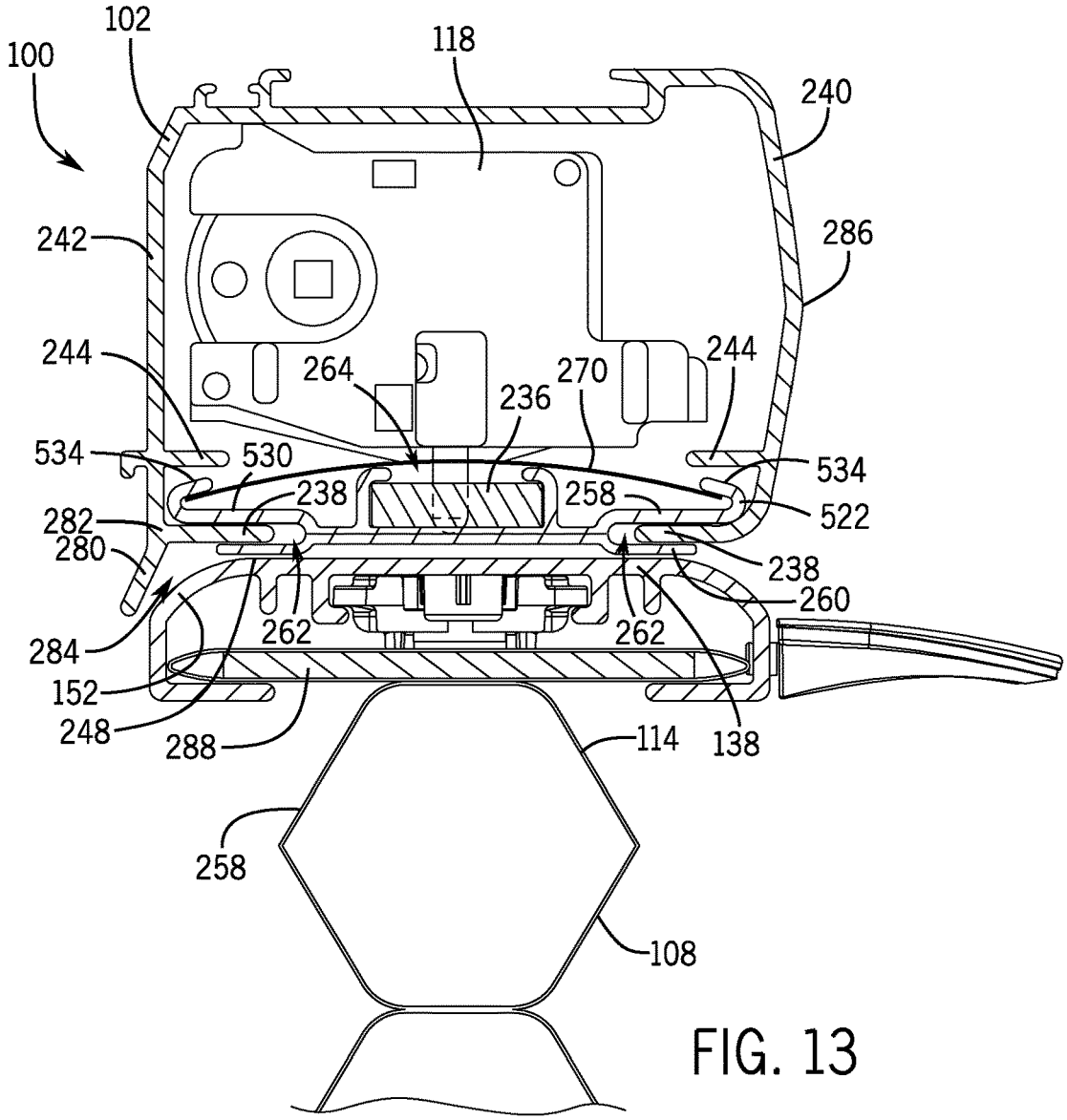
FIG. 13 is a fragmentary side elevation view of a covering utilizing the gasket member of FIG. 12 in accordance with an embodiment of the present disclosure.

FIGS. 12 and 13 illustrate an additional embodiment of a gasket member 522. Like the gasket member 222 discussed above, the gasket member 522 may be associated with the head rail 102 to optimize relative positioning of the movable rail 104 with the head rail 102. In general, the gasket member 522 is similar to the gasket member 222 and its associated description above and thus, in certain instances, descriptions of like features will not be discussed when they would be apparent to those with skill in the art in light of the description above and in view of FIGS. 12 and 13. For ease of reference, like structure is represented with appropriately incremented reference numerals.

Referring to FIGS. 12 and 13, similar to the gasket member 222 discussed above, the gasket member 522 may be an elongate member positioned at least partially within the head rail 102. As shown, the gasket member 522 may include front and rear portions 528, 530 and an offset intermediate portion 532 positioned between and interconnecting the front and rear portions 528, 530. Flanges 534 may extend from an end of each of the front and rear portions 528, 530 to facilitate engagement of the gasket member 522 within the head rail 102 in substantially the same manner as described above with reference to flanges 234 of gasket member 222. In some embodiments, the gasket member 522 may include a pair of securing flanges 260 extending outwardly from the intermediate portion 532. As illustrated, the securing flanges 260 may extend at vertically-spaced relationships with the front and rear portions 528, 530 so as to define retention grooves 262 in which the tabs 238 of the head rail 102 may be received (see FIG. 13), such as to further secure the gasket member 522 to the head rail 102. Once the gasket member 522 is coupled to the head rail 102, the securing flanges 260 may extend below the head rail 102. To magnetically secure the movable rail 104 to the gasket member 522, a retention channel 264 may be formed along at least a portion of the longitudinal length of the gasket member 522 in which the one or more magnets 236 may be retained. As shown, the retention channel 264 may be defined by a pair of longitudinally-extending ribs 266 having inwardly-directed shelves 268. With reference to FIG. 13, the gasket member 522 may include a filler strip 270 onto which lift system components, such as the drive mechanism 118, may be mounted. In such embodiments, the flanges 534 may be bent inwardly to secure the filler strip 270 to the gasket member 534.

In some embodiments, the covering 100 may include a quiet closure design to eliminate or reduce the sound created when the movable rail 104 attaches to the head rail 102. In one embodiment, a damping element, such as an acoustic material, may be associated with at least one of the head rail 102, the movable rail 104, and the gasket member 222 or 522 to reduce noise created upon engagement between the movable rail 104 and the head rail 102. For example, the movable rail 104, the gasket member 222 or 522, and/or the head rail 102 may be formed at least partially from an acoustic material, such as glass fiber filled PET, rigid or soft PVC, or the like, designed to reduce noise created upon engagement (e.g., impact) between the movable rail 104, the gasket member 222 or 522, and/or the head rail 102. Additionally or alternatively, the movable rail 104, the gasket member 222 or 522, and/or the head rail 102 may be coated at least partially with an acoustic material, such as santoprene or the like, to improve its respective sound quality by, for example, reducing propagation of sound waves through the movable rail 104, the gasket member 222 or 522, and/or the head rail 102 upon impact between the components. The acoustic material preferably is selected to be compatible with the gasket member 222 or 522 to remain coupled therewith.

As one nonexclusive example, with reference to FIGS. 12 and 13, in one embodiment, the gasket member 522 may include first and second portions 272, 274 coextruded together. The first and second portions 272, 274 may be formed from materials, such as PVC or the like, chosen to meet the demands placed on the gasket member 522, and which preferably are compatible to facilitate coextrusion resulting in the two portions remaining coupled together. For example, the first portion 272, which may be referred to as an upper portion, an interior portion, or a securing portion, may be extruded from a relatively rigid material to facilitate securement of the gasket member 522 within the head rail 102. In such embodiments, the second portion 274, which may be referred to as a lower portion, an exterior portion, or a damping portion, may be extruded from a relatively soft or resilient material to facilitate dampening of noise created upon engagement of the movable rail 104 with the gasket member 522. As illustrated, the first and second portions 272, 274 may be connected together along a line of connection 276 extending within the intermediate portion 532. In such embodiments, the second portion 274 may extend at least partially below the head rail 102 and may include the securing flanges 260.

With reference to FIG. 9, the head rail 102 in one embodiment includes a fin 280. In some embodiments, the fin 280 may extend diagonally outwardly and downwardly from a rear corner 282 of the head rail 102 defined by the rear wall 242 and one of the opposing tabs 238. Though shown as extending from the rear of the head rail 102, additionally or alternatively, the fin 280 may extend from the front of the head rail 102 without departing from the spirit and scope of the present disclosure. In the illustrative embodiment of FIG. 9, the fin 280 is operable to reduce the light that impacts an outer edge of the line of connection 248 (i.e., a light gap) between the movable rail 104 and the head rail 102 when the shade member 108 is in a fully closed configuration by, for example, extending below the line of connection 248 between the head rail 102 and the movable rail 104 to shade the outer edge of the line of connection 248. As such, the amount of light that impinges on the outer edge of the line of connection 248 is reduced, at least in part to the double angle pathway created by the fin 280 along the bottom portion of the head rail 102. In some embodiments, a cavity 284 is formed between the fin 280, one of the opposing tabs 238, and the transition region 152 of the movable rail 104 to nest the movable rail 104 beneath the head rail 102 and keep light from reflecting into the line of connection 248 between the movable rail 104 and the head rail 102. For example, the relative angles between the fin 280 and the opposing tab 238 of the head rail 102 and the transition region 152 of the movable rail 104 are such that the amount of light reflecting into the line of connection 248 is minimized. To further reduce the presence of a light gap, a light-absorbing material (e.g., paint, caulk, foil, and/or paper) may be applied to a surface of the fin 280 to inhibit an amount of light reflecting from its surface. Additionally or alternatively, the fin 280 may be operable to guide the movable rail 104 into proper location relative to the head rail 102, such as to a closed position adjacent the head rail 102. For example without limitation, the fin 280 may be operable to position the movable rail 104 in substantially parallel alignment with the head rail 102 when, for instance, the movable rail 104 is engaged with the head rail 102

With continued reference to FIG. 9, the front wall 240 of the head rail 102 may be configured to eliminate sight lines and generally emulate the look of the shade member 108. For example, the front wall 240 may be formed with a continuous curvature between a top portion and a bottom portion of the head rail 102. The front wall 240 may include an apex 286 positioned between the top and bottom portions of the head rail 102. As seen in FIG. 9, the apex 286 generally emulates the look of the shade member 108, at least when the shade member 108 is in an extended configuration.

Figure 11:
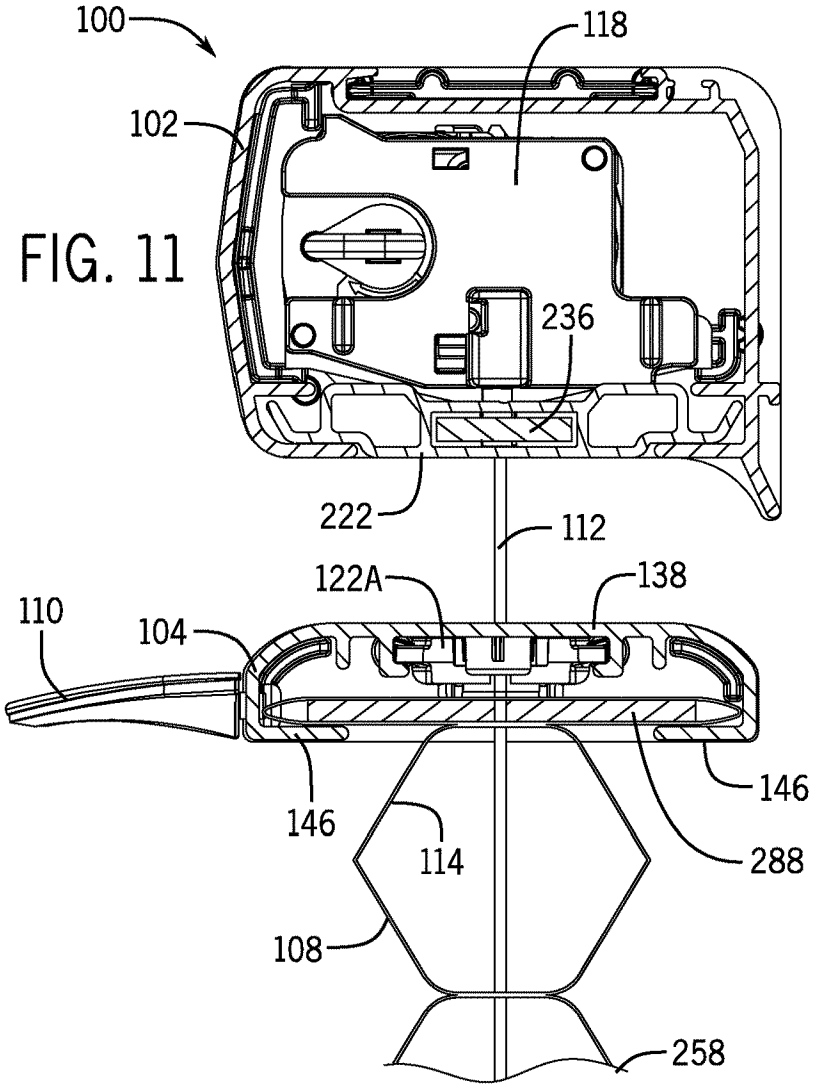
FIG. 11 is an enlarged, fragmentary right side elevation view of the covering of FIG. 1 showing the shade member in an extended, partially open configuration in accordance with an embodiment of the present disclosure.
Figure 10:
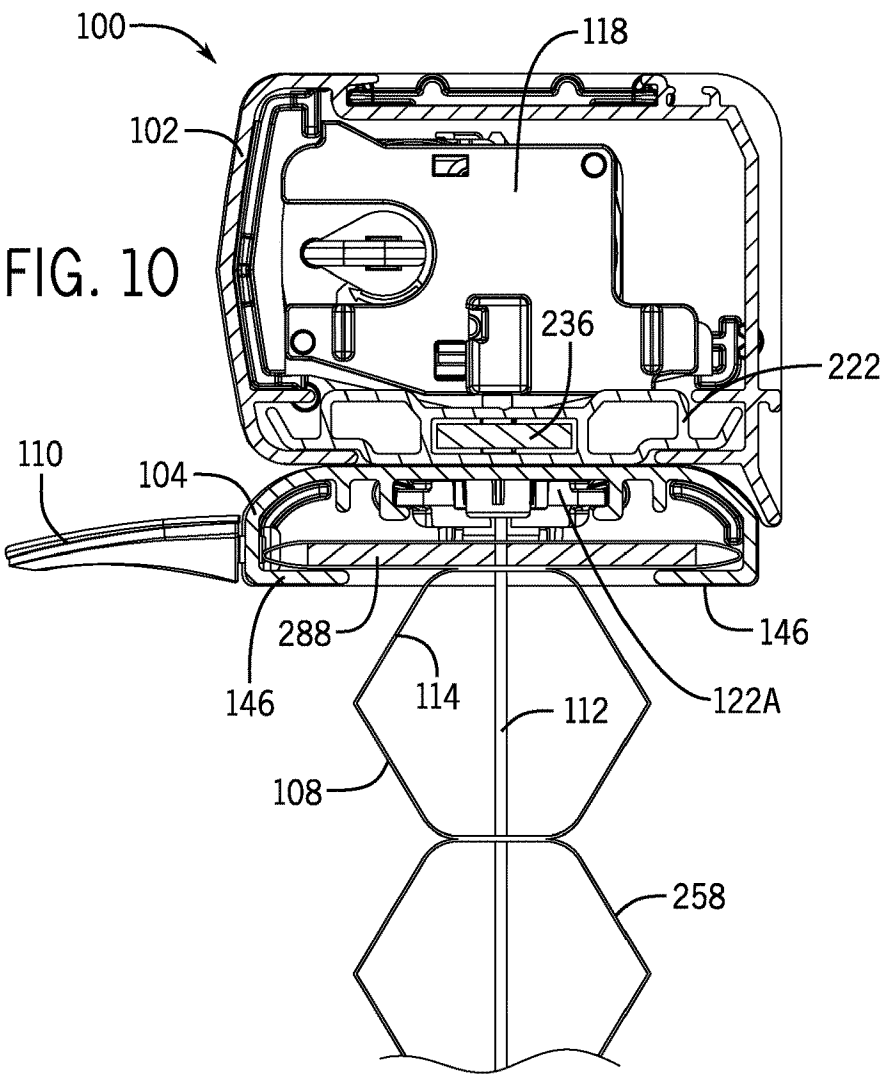
FIG. 10 is an enlarged, fragmentary right side elevation view of the covering of FIG. 1 showing the shade member in an extended, closed configuration in accordance with an embodiment of the present disclosure.

FIG. 10 is an enlarged, fragmentary right side section view of an illustrative embodiment of the covering 100 showing the shade member 108 in an extended, closed configuration in accordance with principles of the present disclosure. FIG. 11 is an enlarged, fragmentary right side section of an illustrative embodiment of the covering 100 showing the shade member 108 in an extended, partially-open configuration in accordance with principles of the present disclosure. When viewed in sequence, the movable rail 104 is moved away from the head rail 102 from the closed configuration (FIG. 10) to a partially-open configuration (FIG. 11) during operation of the covering 100. To open the shade member 108, the movable rail 104 is disengaged from the head rail 102 by the user grasping the handle 110 attached to the movable rail 104 and pulling the movable rail 104 downwardly to overcome the magnetic connection force. To close the shade member 108, a user moves the movable rail 104 towards the head rail 102 until the magnetic force between the magnet assemblies 122A, 122B of the movable rail 104 and the magnet 236 of the gasket member 222 or 522 pulls the top face 138 of the movable rail 104 into engagement with the bottom surface of the head rail 102, with the bottom wall 224 of the gasket member 222, and/or with the securing flanges 260 of the gasket member 522. As noted above, the bottom rail 106 may move towards and away from the head rail 102 independently from the movable rail 104 to respectively retract and extend the shade member 108. For example, a user may move the bottom rail 106 towards and away from the head rail 102 notwithstanding the position of the movable rail 104. Depending on the desired light blocking and occluding configuration, the movable rail 104 and the bottom rail 106 may be positioned at substantially any position relative to each other and to the head rail 102.

With continued reference to FIGS. 10 and 11, the drive mechanism 118 may be housed within the head rail 102. In addition to raising or retracting the movable rail 104 and/or the bottom rail 106, the drive mechanism 118 may be operable to maintain the positions of the movable rail 104 and/or the bottom rail 106 by, for example, selectively locking the lift cords 112 in position. Movement of the movable rail 104 and/or the bottom rail 106 away from and towards the head rail 102 respectively extends and retracts the lift cords 112. Once the movable rail 104 and/or the bottom rail 106 are located in a desired position, the drive mechanism 118 releasably locks the lift cords 112, thereby locking the movable rail 104 and/or the bottom rail 106 in the desired position(s). In some embodiments, the covering 100 may include multiple drive mechanisms 118 to facilitate independent movement of the bottom rail 106 and the movable rail 104. For example, one of the drive mechanisms 118 may be associated with the movable rail 104 and another of the drive mechanisms 118 may be associated with the bottom rail 106. In such embodiments, movement of one of the movable rail 104 and the bottom rail 106 does not interfere with movement of the other of the movable rail 104 and the bottom rail 106.

Although the figures illustrate a honeycomb-type shade member 108, it is contemplated that substantially any type of the shade member 108 may be incorporated according to the present disclosure, including Venetian, Roman, and cellular-type shades. With reference to FIGS. 10 and 11, the first portion 114 of the shade member 108 may be hemmed so a retaining member 288 can be inserted through the hem and longitudinally positioned in the movable rail 104 where it is retained by the opposing flanges 146 of the movable rail 104. As illustrated, the flanges 146 are spaced at a smaller distance apart than the diameter of the retaining member 288 so that the retaining member 288 and the hemmed first portion 114 of the shade member 108 are confined within the movable rail 104. Additionally or alternatively, a poly strip of other such structure may be used to wedge the upper portion of the shade member 108 into the movable rail 104, without the need for a hemmed structure as described herein. The lower portion of the shade member 108 may be similarly configured to connect the shade member 108 to the bottom rail 106.

The foregoing description has broad application. It should be appreciated that the concepts disclosed herein may apply to many types of shades, in addition to the shades described and depicted herein. Similarly, it should be appreciated that the concepts disclosed herein may apply to many types of rails, in addition to the movable rail 104 described and depicted herein. For example, the concepts may apply equally to the bottom rail 106, whether the movable rail 104 is present or not. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A covering for an architectural opening, the covering comprising:

a head rail including a downwardly-directed fin, said fin including a distal end spaced apart from a remainder of said head rail;

a first magnetic element supported by said head rail;

a shade member;

a first rail coupled to said shade member and being positioned vertically below said head rail, said first rail having a retention channel formed in an interior surface of said first rail; and a magnet assembly positioned at least partially within said retention channel, said magnet assembly including a second magnetic element configured to magnetically engage said first magnetic element to releasably secure said first rail to said head rail;

wherein:

said first rail includes a top face facing vertically in a direction towards said head rail and an outer face extending vertically from said top face in a direction away from said head rail; and when said first magnetic element is magnetically engaged with said second magnetic element, said fin extends outwardly from said head rail and vertically overlaps a portion of said outer face of said first rail such that said distal end of said fin is positioned along said outer face of said first rail vertically below an outer edge of a line of connection defined between said first and second magnets.

2. The covering according to claim 1, wherein said fin is operable to engage said first rail along said outer face of said first rail to guide said first rail into position relative to said head rail.

3. The covering according to claim 1, wherein said fin is formed integrally with said head rail.

4. The covering according to claim 1, further comprising a damping element separate from said shade member and being associated with at least one of said head rail or said first rail;

wherein at least a portion of said damping element extends between said first and second magnetic elements when said second magnetic element magnetically engages said first magnetic element to reduce noise created as said first rail is moved into a closed position adjacent said head rail.

5. The covering according to claim 4, wherein:

said head rail includes a gasket member positioned adjacent a bottom side of said head rail;

said damping element is formed by a portion of said gasket member extending at least partially between said first and second magnetic elements when said second magnetic element magnetically engages said first magnetic element.

6. The covering according to claim 4, wherein:

said head rail includes a gasket member positioned adjacent a bottom side of said head rail;

said damping element is formed by or associated with a wall of at least one of said gasket member or said first rail extending at least partially between said first and second magnetic elements when said second magnetic element magnetically engages said first magnetic element.

7. The covering according to claim 1, wherein said magnet assembly includes a locking mechanism configured to be actuated relative to said first rail between a first position, at which said locking mechanism maintains said magnet assembly in a position relative to said first rail, and a second position, at which said second magnetic element and said locking mechanism are movable together along a length of said first rail.

8. The covering according to claim 1, wherein:

said magnet assembly comprises a locking mechanism having a first movable member and a second movable member; and said first movable member of said locking mechanism is adjustable relative to said second movable member of said locking mechanism to move said second movable member from a first position, in which said second magnetic element and said locking mechanism are movable together along a length of said first rail, into a second position of increased frictional engagement with said first rail to restrain said second magnetic element from moving relative to said first rail.

9. A covering for an architectural opening, the covering comprising:

a head rail;

a gasket member coupled to said head rail and being positioned adjacent a bottom side of said head rail;

a first magnetic element supported by said gasket member relative to said, head rail;

a shade member;

a movable rail coupled to and supporting said shade member for movement between an extended position and a retracted position, said movable rail being movable relative to said head rail and said gasket member as said movable rail is moved between the extended and retracted positions; and a second magnetic element supported by said movable rail for movement with said movable rail relative to said head rail and said gasket member, said second magnetic element configured to magnetically engage said first magnetic element as said movable rail is moved into a closed position adjacent said head rail;

wherein a portion of said gasket member forms a damping element extending between said first and second magnetic elements when said second magnetic element magnetically engages said first magnetic element to reduce noise created as said movable rail is moved into the closed position adjacent said head rail.

10. The covering according to claim 9, wherein said damping element is an acoustic material associated with said gasket member.

11. The covering according to claim 9, wherein a top face of said movable rail is configured to contact said portion of said gasket member when said second magnetic element magnetically engages said first magnetic element.

12. The covering according to claim 9, wherein said portion of said gasket member is formed from an acoustic material that differs from a material used to form another portion of said gasket member.

13. The covering according to claim 9, further comprising a fin extending downwardly from said head rail, said fin operable to engage said movable rail to guide said movable rail into said closed position.

14. The covering according to claim 13, wherein, when said first magnetic element is magnetically engaged with said second magnetic element, said fin extends from said head rail to a position vertically below an outer edge of a line of connection defined between said head rail and said movable rail.

15. The covering according to claim 9, wherein:

said second magnetic element forms part of a magnet assembly; and said magnet assembly includes a locking mechanism configured to be actuated relative to said movable rail between a first position, at which said locking mechanism maintains said magnet assembly in a position relative to said movable rail, and a second position, at which said second magnetic element and said locking mechanism are movable together along a length of said movable rail.

16. The covering according to claim 9, wherein:

said second magnetic element forms part of a magnet assembly;

said magnet assembly comprises a locking mechanism having a first movable member and a second movable member; and said first movable member of said locking mechanism is adjustable relative to said second movable member of said locking mechanism to move said second movable member from a first position, in which said second magnetic element and said locking mechanism are movable together along a length of said movable rail, into a second position of increased frictional engagement with said movable rail to restrain said second magnetic element from moving relative to said movable rail.

* * * * *